United States Patent [19]

Suzuki et al.

[11] Patent Number: 5,061,881

[45] Date of Patent: Oct. 29, 1991

[54] IN-LINE ELECTRON GUN

[75] Inventors: Hiroshi Suzuki, Nagaokakyo; Koichi Sugahara, Sakai; Noboru Tominaga, Takatsuki, all of Japan

[73] Assignee: Matsushita Electronics Corporation, Osaka, Japan

[21] Appl. No.: 576,260

[22] Filed: Aug. 31, 1990

[30] Foreign Application Priority Data

Sep. 4, 1989 [JP] Japan ..... 1-228556
Sep. 6, 1989 [JP] Japan ..... 1-230978

[51] Int. Cl.[5] ..... H01J 29/58

[52] U.S. Cl. ..... 315/382; 315/15; 313/414; 313/449

[58] Field of Search ..... 315/382, 15; 313/414, 313/449

[56] References Cited

U.S. PATENT DOCUMENTS 4,772,827 9/1988 Osakabe ..... 315/382
4,814,670 3/1989 Suzuki et al. ..... 315/15
4,851,741 7/1989 Shirai et al. ..... 315/382

FOREIGN PATENT DOCUMENTS 231964 12/1987 European Pat. Off. .
1381018 1/1975 United Kingdom .
1523304 8/1978 United Kingdom .
1523305 8/1978 United Kingdom .

*Primary Examiner*—Theodore M. Blum
*Attorney, Agent, or Firm*—Panitch Schwarze Jacobs & Nadel

[57] ABSTRACT

The invention provides an in-line electron gun in which first astigmatic lens fields that are convergent in a horizontal direction and divergent in a vertical direction are produced between a first focusing grid and a second focusing grid, and second astigmatic lens fields that are divergent in a horizontal direction and convergent in a vertical direction are produced upstream of the first focusing grid. The lens magnifications in both horizontal and vertical directions can be made substantially equal, so that it is possible to achieve a satisfactory resolution over the entire area of the phosphor screen and also to prevent moire occurrences.

4 Claims, 12 Drawing Sheets

IN-LINE ELECTRON GUN

BACKGROUND OF THE INVENTION

1. Field of the invention

This invention relates to an in-line electron gun that can attain a high degree of resolution over the entire area of a phosphor screen. The in-line electron gun is used in a color cathode ray tube apparatus.

2. Description of the prior art

The resolution characteristics of a cathode ray tube apparatus depends largely upon the size and configuration of beam spots. In other words, satisfactory resolution characteristics cannot be obtained unless beam spots produced on the phosphor screen by impingement of electron beams are diametrally small and close to roundness in shape.

However, since the path of electron beams from the electron gun to the phosphor screen becomes longer as the deflection angle of the electron beams becomes larger, if an optimum focus voltage at which small-diameter and round beam spots are obtainable at the center of the phosphor screen is maintained in the path of electron beams, beam spots in the peripheral area of the phosphor screen will be in an over-focus condition, therefore, no small-diameter beam spots can be obtained in the peripheral area, it being thus impossible to achieve any satisfactory resolution in that area.

For this reason, there has been employed a dynamic focus system in which the focus voltage is increased with an increase in the deflection angle of the electron beams so as to decrease the main-lens action. As discussed below however, such a system is not suitable for use in driving in-line electron guns. In an in-line electron gun having three electron beam radiating units horizontally aligned, the horizontal deflection fields are distributed in a pin-cushionshaped distorted fashion and the vertical deflection fields are distributed in a barrel-shaped distorted fashion so as to ensure that the effect of self-convergence can be achieved. Therefore, the three electron beams passing through the fields are subjected to a divergent lens action in a horizontal direction and to a convergent lens action in a vertical direction, the beam spots being thus of a horizontally elongated flat shape in section.

The above mentioned divergent lens action serves to negate the phenomenon that the path of each electron beam becomes longer as the deflection angle of the electron beam becomes larger, which causes the over-focusing of the beam spots, so that the beam spots can be maintained in the optimum focus condition throughout the entire period of deflection as far as their arrangement in the horizontal directions is concerned. In the vertical directions however, the application of the above mentioned convergent lens action results in an increase in the over-focusing action, so that the beam spots involve an elongated low luminance haze portion, which causes deterioration of the resolution. If an attempt is made to correct the over-focusing action by the above-mentioned dynamic focus system, the beam spots will be horizontally under-focused, and no reasonable correction effect can be obtained.

An improvement with respect to such a problem can be achieved by, for example, an in-line electron gun described in (U.S. Pat. No. 4,814,670), in which, as shown in FIG. 13, cathodes 1*a*, 1*b*, 1*c*, control grid 2, an accelerating grid 3, a first focusing grid 4, a second focusing grid 5, and an anode 6 are arranged in this order. Moreover, as shown in as FIGS. 14*a* and 14*b*, the first focusing grid 4 has vertically elongated electron-beam through-holes 4*a*, 4*b*, 4*c* at its end adjacent to the second focusing grid 5, and the second focusing grid 5 has horizontally elongated electronbeam through-holes 5*a*, 5*b*, 5*b* at its end adjacent to the first focusing grid 4. The second focusing grid 5 and the anode 6 respectively have main lens forming electron-beam through-holes 5*d*, 5*e*, 5*f* and 6*a*, 6*b*, 6*c*. Constant focus voltage $V_{foc}$ is applied to the first focusing grid 4; constant high voltage is applied to the anode 6; and a dynamic voltage is applied to the second focusing grid 5, the dynamic voltage gradually rising from the focus voltage $V_{foc}$ in response to upward changes in the deflection angle of the electron beams. When the potential of the second focusing grid 5 becomes higher than the potential $F_{foc}$ of the first focusing grid 4 as a result of the application of the dynamic voltage to the second focusing grid 5, quadripole lens fields are formed between the two grids 4 and 5 through the intermediary of both the vertically elongated electron-beam through-holes 4*a*, 4*b*, 4*c* and the horizontally elongated electron-beam through-holes 5*a*, 5*b*, 5*c*, and the difference in potential between the second focusing grid 5 and the anode 6 is reduced, with the result that the lens action of the main lens is attenuated. As a consequence, beam spots formed by the impingement of electron beams deflected toward peripheral edge portions of the phosphor screen will no longer involve any low luminance haze portion in vertical directions while, at same time, they are kept in the optimum focus condition in horizontal directions. The reference numeral 7 is a dynamic pressure generating circuit.

However, the conventional arrangement has a drawback in that interference between the scan lines for electron beams and the holes of the shadow mask is likely to occur to produce moire (a stripe pattern with alternate bright and dark portions). Moire is a kind of image noise which, if it occurs, not only adversely affects the image quality, but is also uncomfortable to the eyes.

Moire is more likely to occur where each beam spot is smaller in vertical diameter. In designing an electron gun, therefore, care must be used to ensure that the vertical diameter of the beam spot is not too small. However, in such conventional electron gun as described above, when a dynamic voltage variable enough to bring beam spots into the optimum focus condition at their respective positions on the phosphor screen is applied to the second focusing grid, beam spots g at peripheral edge portions of the phosphor screen have no low luminance haze portion; but as shown in FIG. 15, they present a horizontally elongated configuration formed from a high luminance core portion only, with a reduced vertical diameter size. The vertical diametral size of such a beam spot becomes excessively small when a low beam current is present at which time the diameter of each beam spot becomes the smallest, and moire is thus very likely to occur.

The phenomenon that beam spots present a horizontally elongated configuration despite the fact that electron beams are in the optimum focus condition in both horizontal and vertical directions in attributable to the nature of the above-described conventional electron lens system. This will be explained with reference to FIG. 16 which illustrates the behavior of an electron beam subjected to deflection in a horizontal direction and held in the optimum focus condition through application of a dynamic voltage. FIG. 16*a* shows a horizontal sectional view and FIG. 16*b* shows a vertical sectional view taken along the direction of electron beam deflection. The reference numeral 10 designates a cross-over portion of the electron beam which corresponds to the object point of the lens system; 11 designates an envelope of the electron beam; 12 designates a main lens; 13 designates a convex lens representing a horizontal convergent lens action of astigmatic lens fields formed between the first focusing grid and the second focusing grid; 14 designates a concave lens representing a vertical divergent lens action of the above-mentioned astigmatic lens fields; 15 designates a concave lens representing a horizontal divergent lens action of a horizontal deflection field of a self-convergence deflection yoke; 16 designates a convex lens representing a vertical convergent lens action of the above-mentioned horizontal deflecton field; and 17 designates a point of impingement of the deflected beam.

In this way, the conventional electron lens system can be represented by being replaced with an optical system in which a convex lens, another convex lens, and a concave lens are arranged in this order from a cross-over portion as the object point 10 in the horizontal direction, and a concave lens, a convex lens, and another convex lens are arranged in this order in the vertical direction. When an attempt is made to attain optimum focus in both horizontal and vertical directions, it is inevitable that the angle of incidence $\alpha'H$ in the horizontal direction becomes smaller because a concave lens is lastly positioned.

In such a lens system, where the angle of incidence of an electron beam projected from the cross-over portion 10 at an angle of $\alpha$ with respect to the center axis and entering the point of incidence 17 on the phosphor screen 8 after passing through the lens system is represented by $\alpha'$, the angle of incidence is different between the horizontal direction and the vertical direction, the vertical angle of incidence $\alpha'_v$ being larger than the horizontal angle of incidence $\alpha'_H$, Generally, magnification M of the electron lens system can be represented by the formula $M=(\alpha-\alpha')\sqrt{V/V}$, wherein V and V' respectively represent the potential at the cross-over portion and the potential on the phosphor screen. Accordingly, magnification $M_H$ of the lens system in the horizontal direction can be represented by the formula $M=(\alpha-\alpha'_H)\sqrt{V/V'}$, and magnification $M_v$ in the vertical direction can be represented by the formula $M_v=(\alpha-\alpha'_v)\sqrt{V.V'}$.

Now, $\alpha'_v>\alpha'_H$, and accordingly $M_v<M_H$. Thus, in the foregoing conventional electron gun, the vertical magnification is smaller than the horizontal magnification and accordingly the vertical diameter of each beam spot becomes smaller, so that moire is more likely to occur.

SUMMARY OF THE INVENTION

The in-line electron gun of this invention, which overcomes the above-discussed and numerous other disadvantages and deficiencies of the prior art, comprises a plate shaped accelerating grid to which a constant accelerating voltage is applied; a box-shaped first focusing grid to which a constant focus voltage is applied; a box-shaped second focusing grid to which a dynamic voltage is applied, said dynamic voltage gradually rising from the focus voltage with an increase in the deflection angle of electron beams, and said three grids being arranged in this order between a control grid and an anode; and an astigmatic lens field forming means which are provided in at least one of the opposed ends of said first and second focusing grids so as to form first lens fields between said two focusing grids, said first lens fields being convergent in a horizontal direction and divergent in a vertical direction, wherein said in-line electron gun comprises a flat plate-shaped first auxiliary grid connected to said first focusing grid; a flat plate-shaped second auxiliary grid connected to said second focusing grid, said auxiliary grids being arranged in this order between said accelerating grid and said first focusing grid; and an astigmatic lens field forming means provided in at least one of the opposed ends of said first and second auxiliary grids so as to form second lens fields between said two auxiliary grids said second lens fields being divergent in a horizontal direction and convergent in a vertical direction.

In a preferred embodiment, the astigmatic lens field forming means are provided in at least one of the opposed ends of said second auxiliary grid and first focusing grid.

In a more preferred embodiment, each electron-beam through-hole of said first auxiliary grid has a non-circular aperture having a horizontally extending major axis, at its end adjacent to said second auxiliary grid; each electron-beam through-hole of said second auxiliary grid has a non-circular aperture having a vertically extending major axis, at its end adjacent to said first auxiliary grid and also has a circular aperture at its end adjacent to said first focusing grid; and said first focusing grid has circular electron-beam through-holes at its end adjacent to said second auxiliary grid.

In a preferred embodiment, each electron-beam through-hole of said first auxiliary grid has a non-circular aperture having a horizontally extending major axis, at its end adjacent to said second auxiliary grid; each electron-beam through-hole of said second auxiliary grid has a non-circular aperture having a vertically extending major axis, at its end adjacent to said first auxiliary grid and also has a circular aperture at its end adjacent to said first focusing grid; and said first focusing grid has circular electron-beam through-holes at its end adjacent to said second auxiliary grid.

Thus, the invention described herein makes possible the objectives of (1) providing an in-line electron gun that attains a high resolution over the entire surface area of the phosphor screen; (2) providing an in-line electron gun that prevent an occurrence of moire troubles; and (3) providing an in-line electron gun in which the first and second auxiliary grids can be connected respectively to the first and second focusing grids within the tube; so that grid terminal drawing pins need not be additionally provided within the tube.

BRIEF DESCRIPTION OF THE DRAWINGS

This invention may be better understood and its numerous objects and advantages will become apparent to those skilled in the art by reference to the accompanying drawings as follows.

DESCRIPTION OF THE PREFERRED EMBODIMENTS

This invention provides an in-line electron gun in which an astigmatic lens field that is convergent in a horizontal direction and divergent in a vertical direction is produced between the first and second focusing grids. Moreover, a reverse-directional astigmatic lens field is produced between the two auxiliary grids positioned upstream of the first focusing grid, the reverse-directional astigmatic lens field being divergent in the horizontal direction and convergent in the vertical direction. Therefore, the magnifications of the lens in the horizontal and vertical directions can be made almost equal, it being thus possible to produce substantially circular beam spots throughout the entire area of the phosphor screen, resulting in a satisfactory resolution over the entire screen area. Moreover, beam spots can be prevented from becoming too small in vertical diameter and thus an occurrence of moire can be prevented.

EXAMPLE 1

Figure 1:
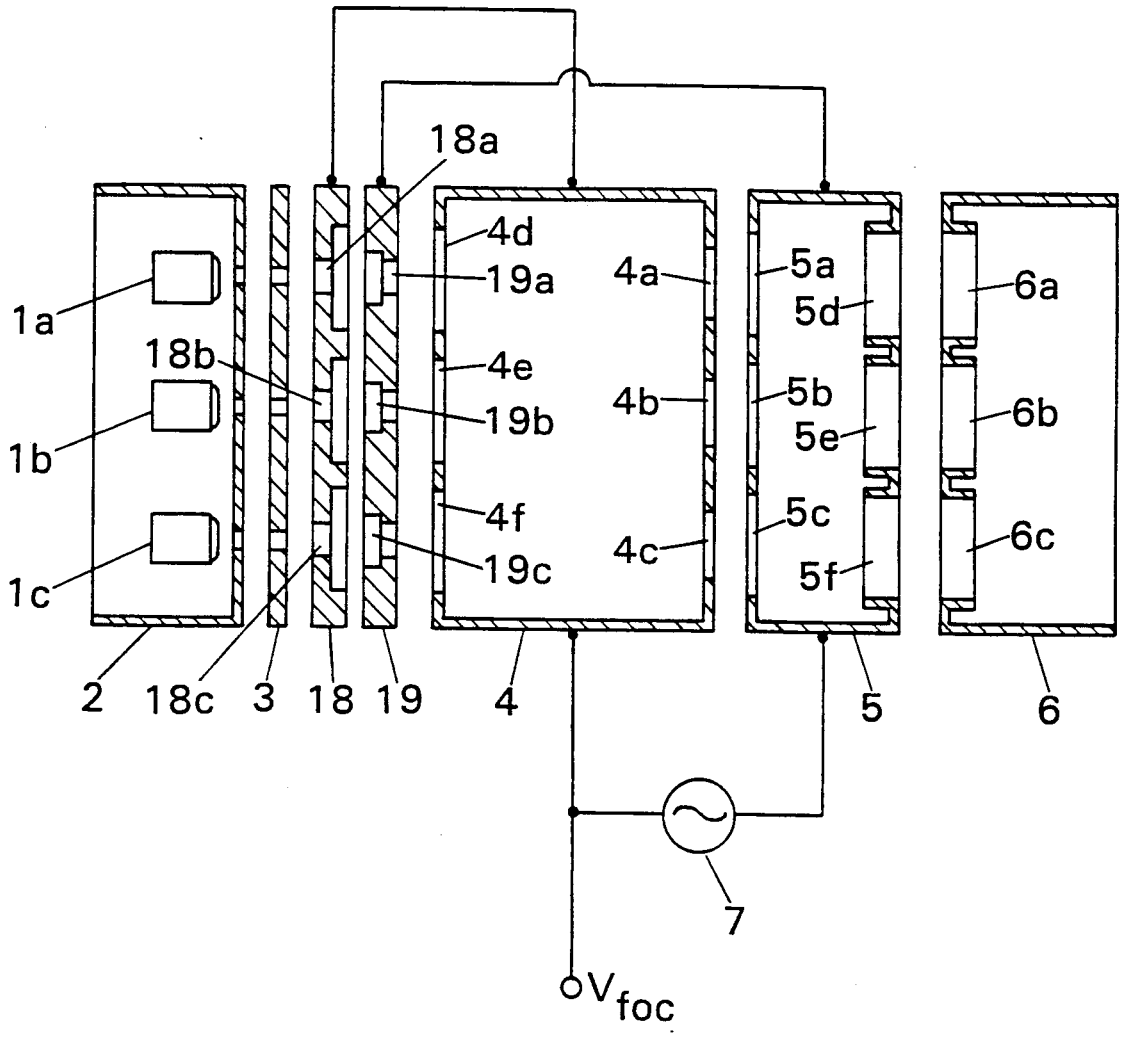
FIG. 1 is a cross-sectional view showing a electron gun of a color cathode ray tube apparatus of this invention.

FIG. 1 shows an in-line electron gun of this invention, which comprises three cathodes 1*a*, 1*b*, 1*c* aligned horizontally in an in-line fashion, a control grid 2, a plate-shaped accelerating grid 3, a plate-shaped first auxiliary grid 18, a plate-shaped second auxiliary grid 19, a box-shaped first focusing grid 4, a box-shaped second focusing grid 5, and an anode 6.

Vertically elongated electron-beam throughholes 4*a*, 4*b*, 4*c* are provided at one end of the first focusing grid 4 which is adjacent to the second focusing grid 5, and horizontally elongated electron-beam through-holes 5*a*, 5*b*, 5*c* are provided at one end of the second focusing grid 5 which is adjacent to the first focusing grid 4, all the through-holes being operative as astigmatic lens field forming means. Electron-beam through-holes 5*d*, 5*e*, 5*f* and 6*a*, 6*b*, 6*c* for serving as main lens field forming means are provided respectively at one end of the second focusing grid 5 which is adjacent to the anode 6 and at one end of the anode 6 which is adjacent to the second focusing grid 5. The above mentioned through-holes are the same as those in the conventional electron gun.

The first auxiliary grid 18 is connected to the first focusing grid 4. Therefore, a constant focus voltage $V_{foc}$ is applied to the auxiliary grid 18. The second auxiliary grid 19 is connected to the second focusing grid 5. Therefore, to the auxiliary grid 19 a dynamic voltage is applied which will gradually rise with an increase in the deflection angle of electron beams.

Figure 2A:
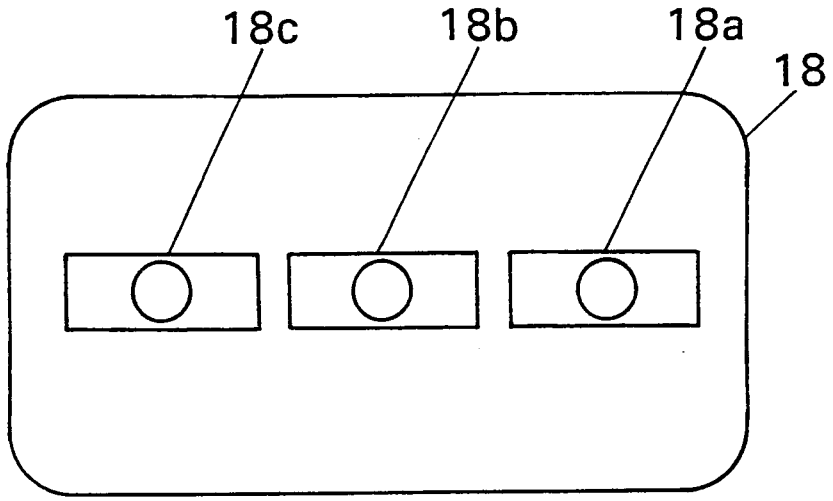
FIGS. 2*a* to 2*c* are side views of grids of the electron gun.
Figure 2B:
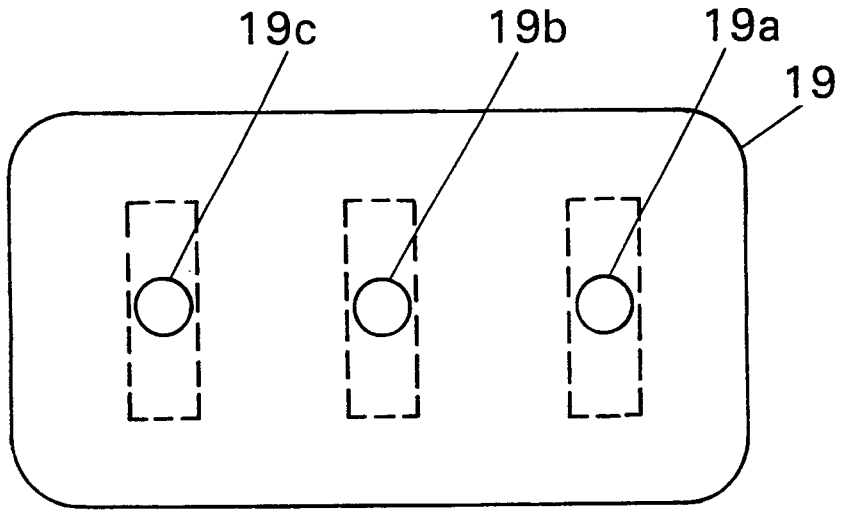
Figure 2C:
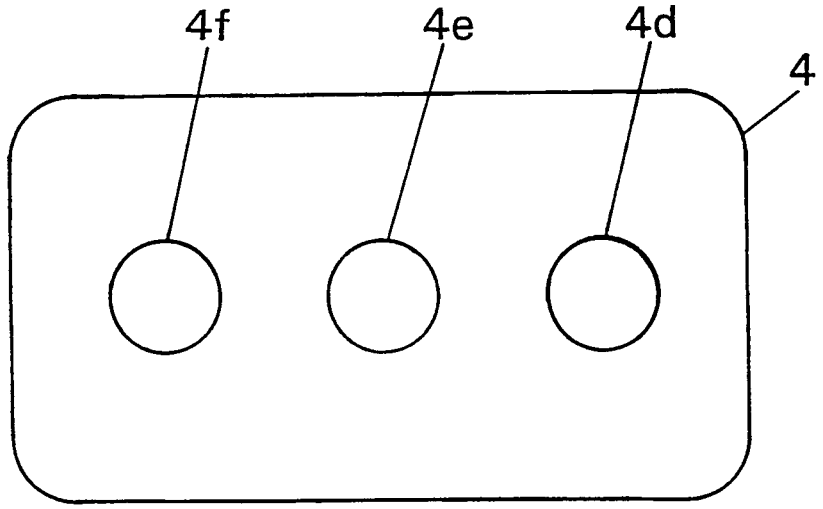

The first auxiliary grid 18 and second auxiliary grid 19 are provided respectively with non-circular electron-beam through-holes 18*a*, 18*b*, 18*c* and 19*a*, 19*b*, 19*c* as shown in FIGS. 2*a* and 2*b*, the throughholes being all operative as astigmatic lens field forming means. Each of the electron-beam through-holes 18*a*, 18*b*, 18*c* of the first auxiliary grid 18 has a circular aperture at its end adjacent to the accelerating grid 3 and a horizontally rectangular aperture at its end adjacent to the second auxiliary grid 19. Each of the electron-beam through-holes 19*a*, 19*b*, 19*c* of the second auxiliary grid 19 has a rectangular aperture having a vertically extending major axis, at its end adjacent to the first auxiliary grid 18 and a circular aperture at its end adjacent to the first focusing grid 4. The first focusing grid 4 has, at its end adjacent to the second auxiliary grid 19, circular electron-beam through-holes 4*d*, 4*e*, 4*f* as shown in FIG. 2*c*.

Therefore, as the deflection angle of electron-beams becomes larger, potential differences will be produced between the first auxiliary grid 18 and the second auxiliary grid 19 and between the second auxiliary grid 19 and the first focusing grid 4, with the result that astigmatic lens fields which are divergent in a horizontal direction and convergent in a vertical direction is produced between the two auxiliary grids 18 and 19. Lens fields are also produced between the second auxiliary grid 19 and the first focusing grid 4, but their lens action is rather faint because the diameter of each of the electron-beam through-holes 4*d*, 4*e*, 4*f* is relatively large.

The cross-over portion of each electron beam is usually formed adjacent to the accelerating grid 3. The astigmatic lens fields are formed only between the two auxiliary grids 18 and 19, and therefore the said lens fields are proximate to the cross-over portion. The astigmatic lens fields, which are formed in proximity to the cross-over portion, i.e., in this way, an object point of the lens system, only acts to change the angular position of each electron beam, or more particularly, to widen the electron beam horizontally and narrow it vertically. Therefore, it is most unlikely that a positional change will occur with respect to the object point of a virtual image in either the horizontal or virtual direction.

Figure 3A:
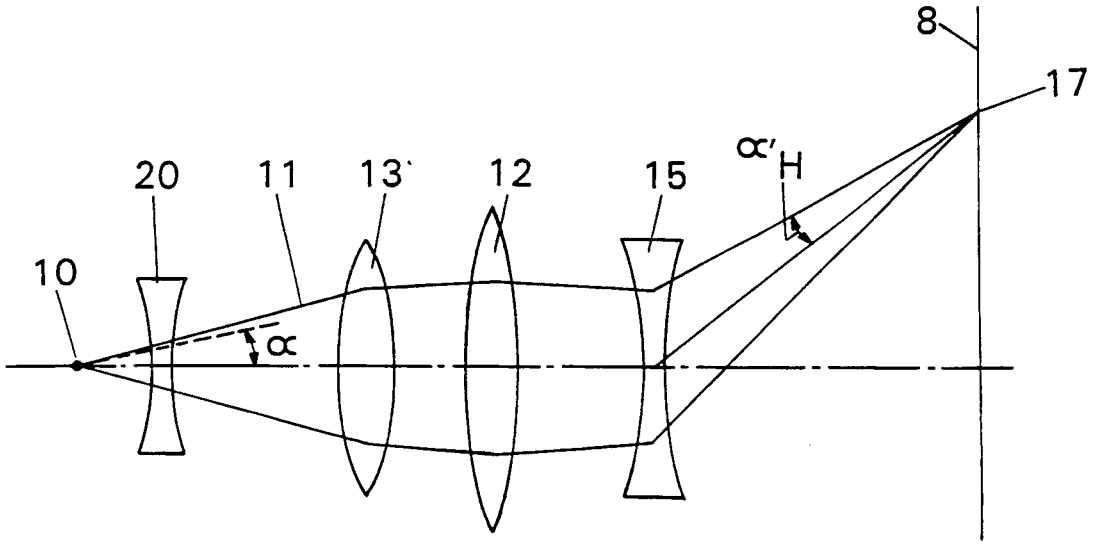
FIGS. 3*a* and 3*b*, respectively, are schematic diagrams showing an optical lens system in place of horizontal and vertical lens fields acting on electron beams in the gun of FIG. 1.
Figure 3B:
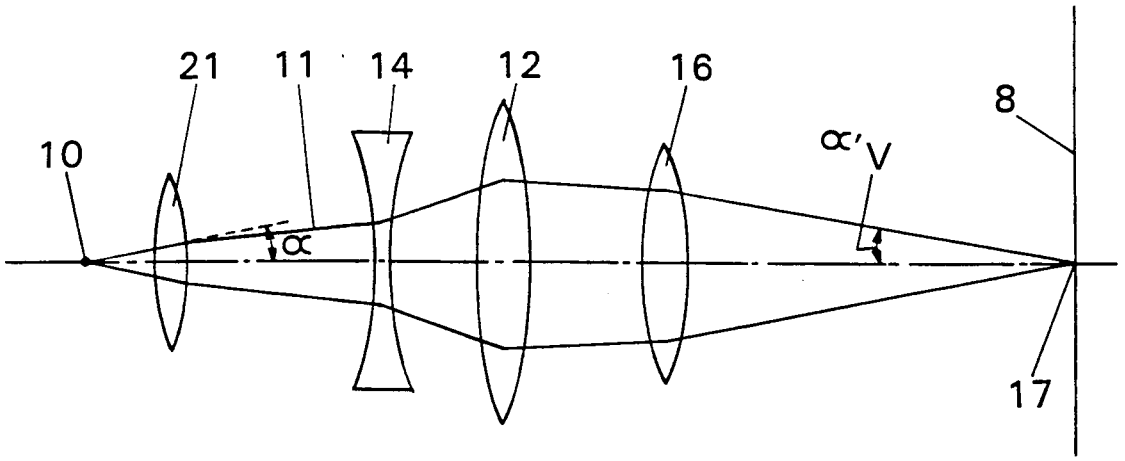

The behavior of an electron beam will be explained with reference to FIG. 3. FIG. 3*a* shows a horizontal section, and FIG. 3*b* shows a vertical section taken along an electron beam subjected to deflection, in which a horizontally divergent lens action of astigmatic lens fields formed by the first and second auxiliary grids is represented by a concave lens 20, and a vertically convergent lens action of the said lens fields is represented by a convex lens 21. Other reference numerals in the drawings correspond to those referred to earlier.

An electron beam projected from the crossover portion 10 at an angle of $\alpha$ with respect to the center axis is subjected to a divergent lens action by the concave lens 20 in the horizontal direction and to a convergent lens action by the convex lens 21 in the vertical direction. Therefore, the beam is widened to an angle larger than in the horizontal direction, while it is narrowed to an angle smaller than $\alpha$ in the vertical direction. The position of the object point seen from the electron beam which has passed through the astigmatic lens fields 20, 21, that is, the position of the object point of the virtual image, is generally located behind the cross-over portion 10. However, as mentioned above, the astigmatic lens fields 20, 21 are formed in proximity to the cross-over portion; therefore, the deviation of the object point from the cross-over portion is very small and the object point is always positioned very close to the cross-over portion. This means that even when the astigmatic lens fields 20, 21 are added, the image formation of the lens system as a whole is little affected. Therefore, with respect to the first focusing grid 4 and other parts positioned downstream of the first focusing grid 4, the conventional lens system is applicable to this invention as it is.

Because of the fact that the angle of each electron beam is widened to an angle larger than $\alpha$ in the horizontal direction and the angle of each electron beam is narrowed to an angle smaller than $\alpha$ in the vertical direction by the astigmatic lens fields 20, 21, it is unlikely that the vertical angle of incidence $\alpha'_V$ of the electron beam incident upon a horizontally deflected point 17 of impingement will be excessively larger than the horizontal angle of incidence $\alpha'_H$. Therefore, the value of $\alpha_V$ nearly equals to the value of $\alpha'_H$ (i.e., $\alpha'_V \simeq \alpha'_H$) In other words, vertical magnification $M_V$ and horizontal magnification $M_H$ can be made to meet the following relation; $M_V \simeq M_H$.

Although the above-described example only discloses that the electron beam is horizontally deflected on the phosphor screen, the foregoing explanation is equally applicable to the case in which the beam is vertically deflected.

Figure 4:
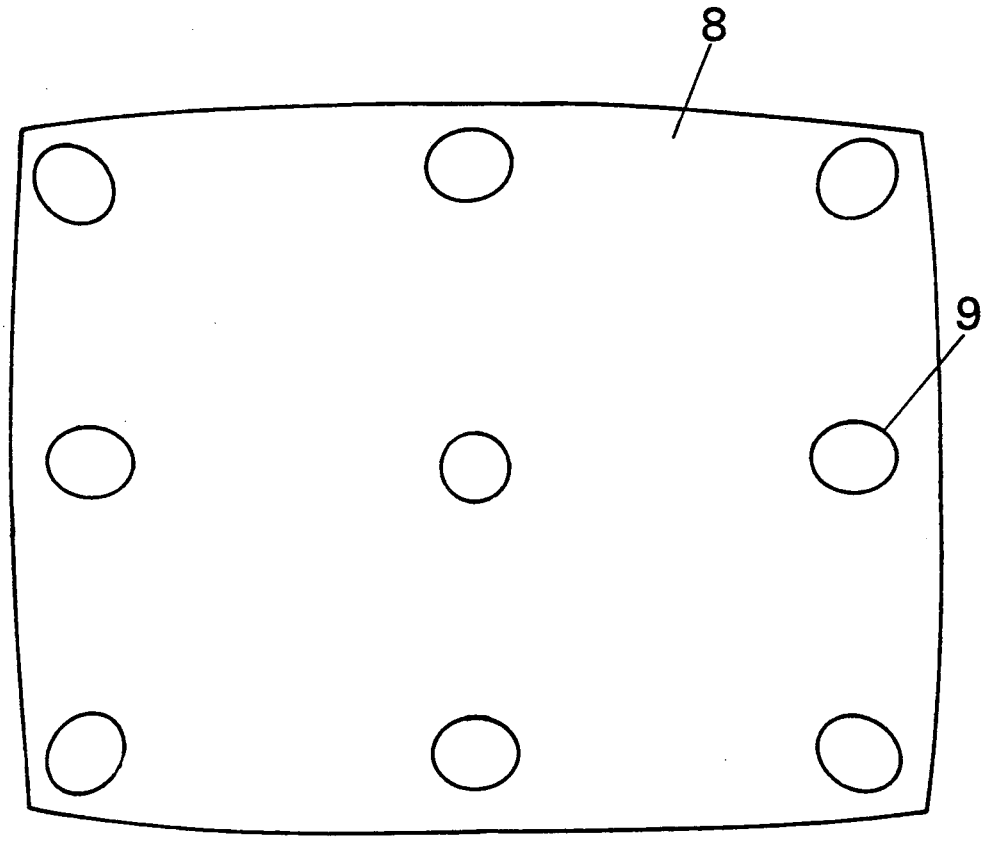
FIG. 4 is a plan view schematically showing the configuration of beam spots formed on the phosphor screen of the apparatus.

As described above, by the application of dynamic voltage it is possible to constantly maintain the beam spots in the optimum focus condition not only in the horizontal direction but also in the vertical direction and also to maintain each lens system at substantially the same magnification in both the horizontal and vertical directions. Therefore, even the beam spots formed by electron beams deflected toward peripheral edge portions of the phosphor screen can be made nearly round as shown in FIG. 4, it being thus possible to prevent the beam spots from becoming excessively small in vertical diameter. Hence, it is possible to have a high quality picture image produced on the phosphor screen which is of a high resolution and free of moire.

In one example in which a 110° deflection angle type in-line electron gun is employed, where the final accelerating voltage is 30 KV and the focus voltage applied to the first focusing grid 4 and first auxiliary grid 18 is 8 KV, the dynamic voltage applicable to the second focusing grid 5 and second auxiliary grid 19 is about 1.2 KV on the basis (OV) of the focus voltage of 8 KV. In other words, the optimum value for the dynamic voltage at maximum amplitude is about 1.2 KV.

When an effective aperture of the main lens is 7.8 mm, the distance from the astigmatic lens formed between the two focusing grids to the main lens can be 12.5 mm. In this case, dimensions of rectangular electron-beam through-holes of the focusing grids may be 4.5 mm on the longer side and 3.6 mm on the shorter side. The distance between the astigmatic lens and the second auxiliary grid 19 can be set at 19.5 mm, and the distance between the second auxiliary grid 19 and the cathode can be set at 4 mm.

The horizontally elongated aperture of each electron-beam through-hole of the first auxiliary grid 18 and the vertically elongated aperture of each electron-beam through-hole of the second auxiliary grid 19 are selected so that the vertical angle of incidence $\alpha_V$ and horizontal angle of incidence $\alpha'_H$ meet the relation $\alpha'_H \simeq \alpha'_V$. Where the distance between the first auxiliary grid 18 and the second auxiliary grid 19 is 0.5 mm, each of the horizontally elongated apertures and vertically elongated apertures may be set 3 to 4 mm on the longer side and 1 to 2 mm on the shorter side.

EXAMPLE 2

Figure 5:
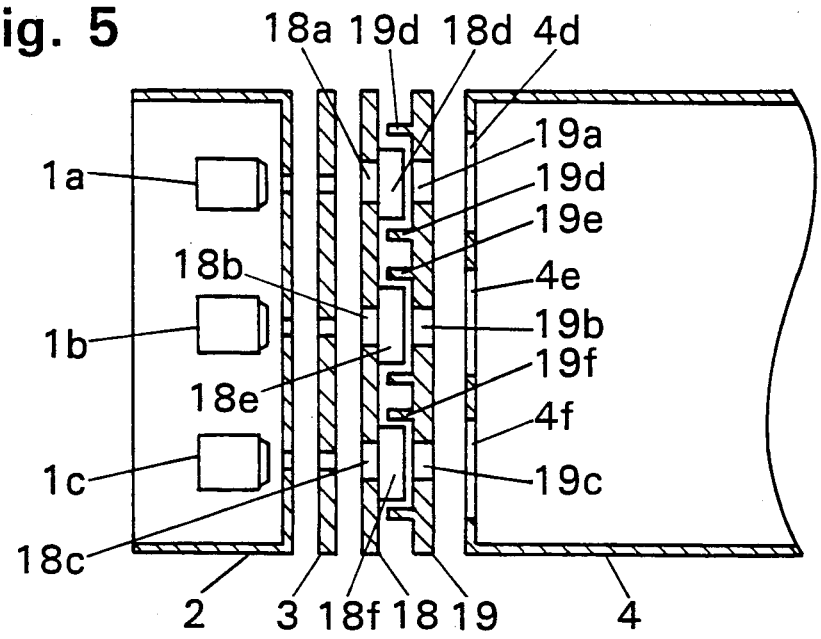
FIG. 5 is a cross-sectional view showing a main portion of another electron gun of this invention.
Figure 6A:
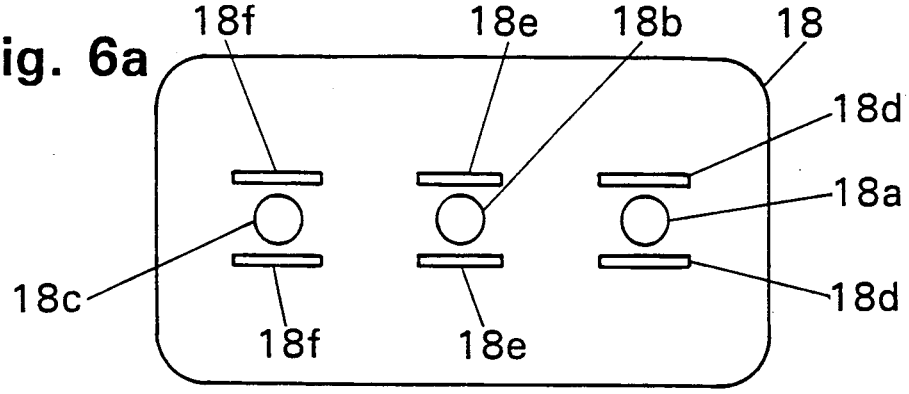
FIGS. 6*a* to 6*c* are side views of individual grids of the electron gun.
Figure 6B:
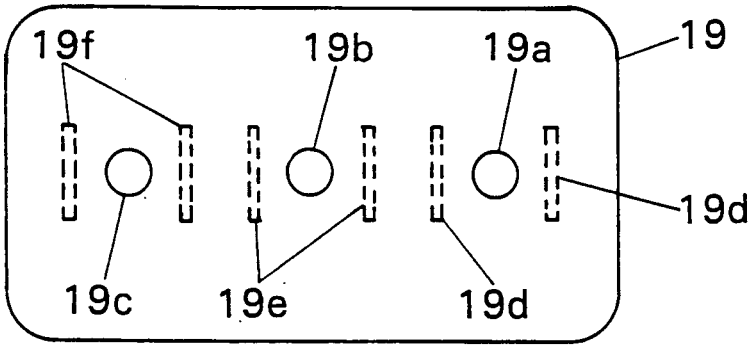
Figure 6C:
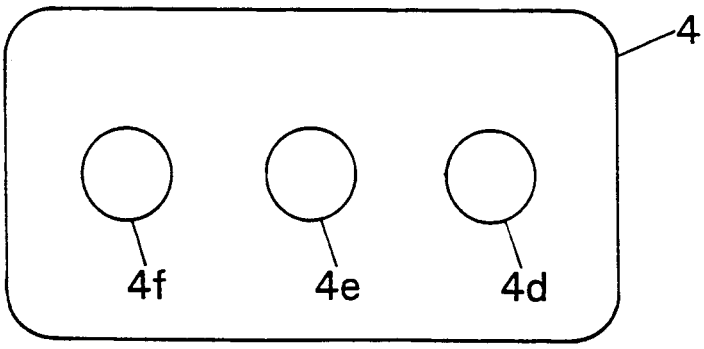

FIG. 5 shows another in-line electron gun of this invention, in which the electron-beam through-holes holes of the first and second auxiliary grids 18, 19 and those of the first focusing grid 4 at its end adjacent to the second auxiliary grid 19 are roundshaped, and as shown in FIGS. 6*a* and 6*b*, the first auxiliary grid 18 is provided, at each end adjacent to the second auxiliary grid 19, with a pair of ledge portions 18*d*, 18*e* and 18*f* projecting horizontally from positions above and below individual electron-beam through-holes of the grid 18, and the second auxiliary grid 19 is provided, at each end adjacent to the first auxiliary grid 18, with a pair of ledge portions 19*d*, 19*e*, and 19*f* projecting vertically from positions at opposite sides of individual electron-beam throughholes of the grid 19, the said ledge portions being operative as astigmatic lens field forming means.

By arranging respective pairs of the horizontal and vertical ledge portions in an opposed relationship in this way, it is possible to cause astigmatic lens fields to be produced in the same manner as in the case where non-circular electron-beam through-holes are arranged to face each other.

EXAMPLE 3

Figure 7:
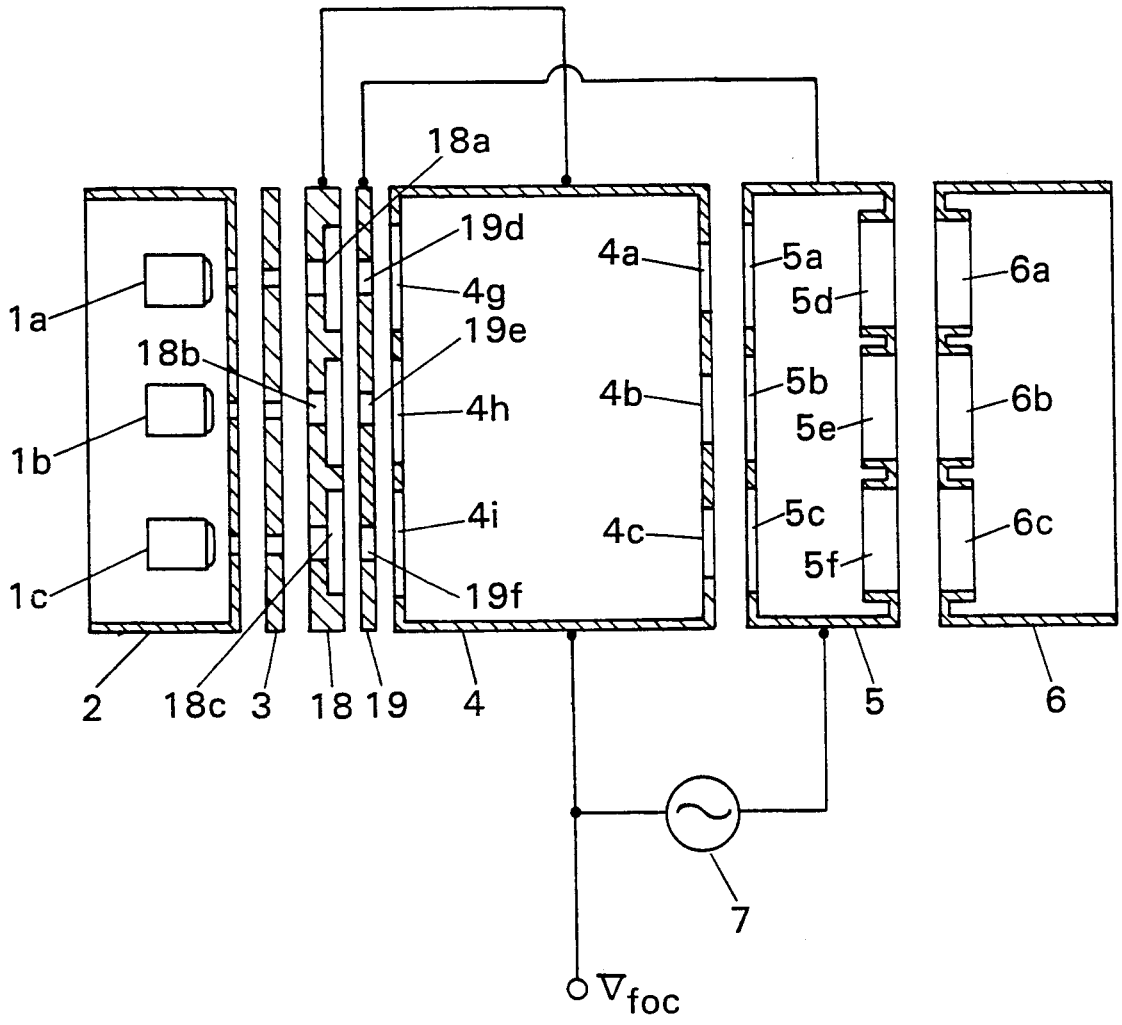
FIG. 7 is a cross-sectional view showing still another electron gun of this invention.
Figure 8A:
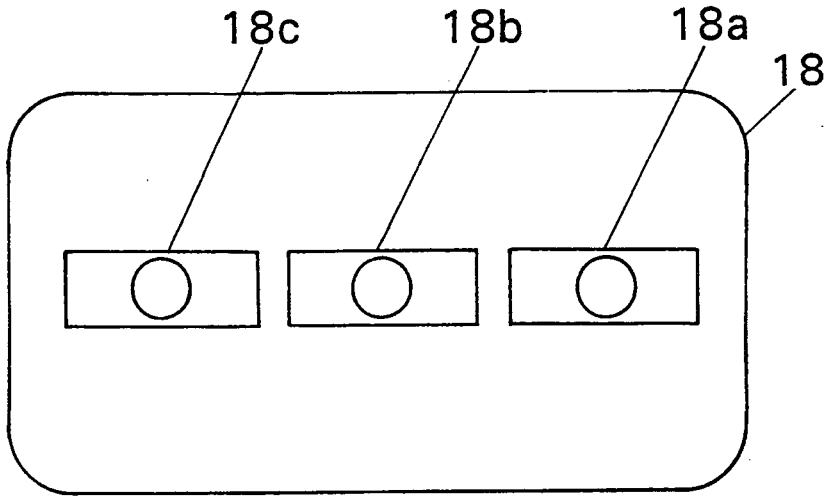
FIGS. 8*a* to 8*c* are side views of individual grids in the electron gun of FIG. 8.
Figure 8B:
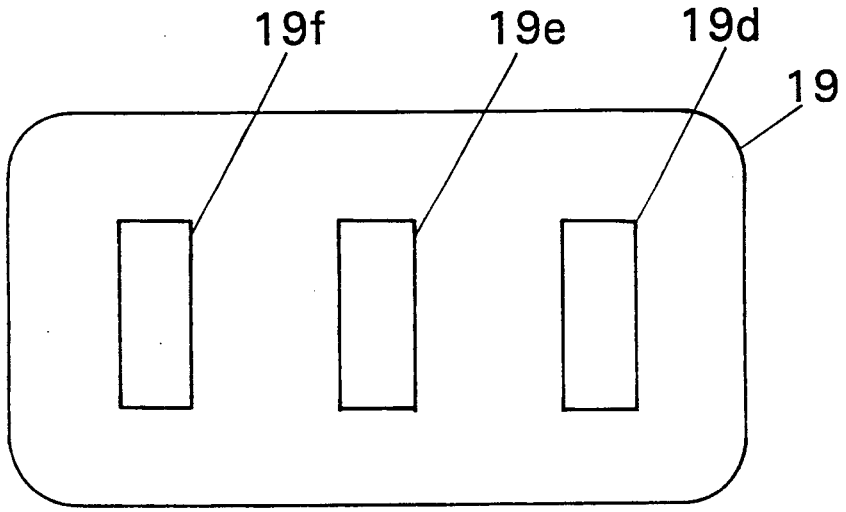
Figure 8C:
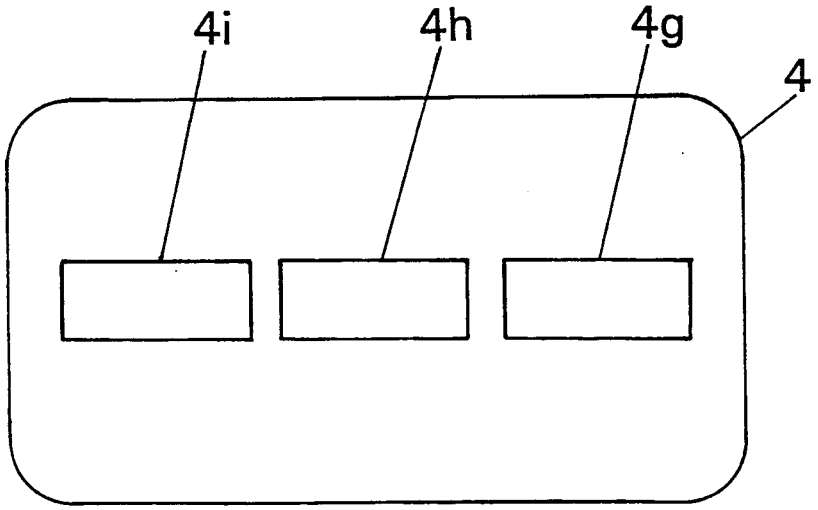

FIG. 7 shows still another embodiment of the invention, in which non-circular electron-beam through-holes 18*a*, 18*b*, 18*c*; 19*d*, 19*e*, 19*f*; and 4*g*, 4*h*, 4*i* are respectively provided in the first auxiliary grid 18, second auxiliary grid 19, and at an end of the first focusing grid 4 adjacent to the second auxiliary grid as shown in FIGS. 8*a*, 8*b* and 8*c*, the throughholes being operative as astigmatic lens field forming means. Each of the electron-beam through-holes 18*a*, 18*b*, 18*c* has a circular aperture at its end adjacent to the accelerating grid 3, and a horizontally elongated aperture at its end adjacent to the second auxiliary grid 19. Each of the electron-beam through-holes 19*d*, 19*e*, 19*f* is of a rectangular shape with a vertically extending major axis, and each of the electron-beam through-holes 4*g*, 4*h*, 4*i* provided at one end of the first focusing grid 4 adjacent to the second auxiliary grid 19 is of a rectangular shape with a horizontally extending major axis. When this arrangement is employed, lens fields are formed not only between the first and second auxiliary grids 18 and 19, but also are formed between the second auxiliary grid 19 and the first focusing grid 4. These lens fields, in combination, perform concave and convex lens actions such as those shown at 20 and 21 in FIGS. 3*a* and 3*b*.

EXAMPLE 4

Figure 9:
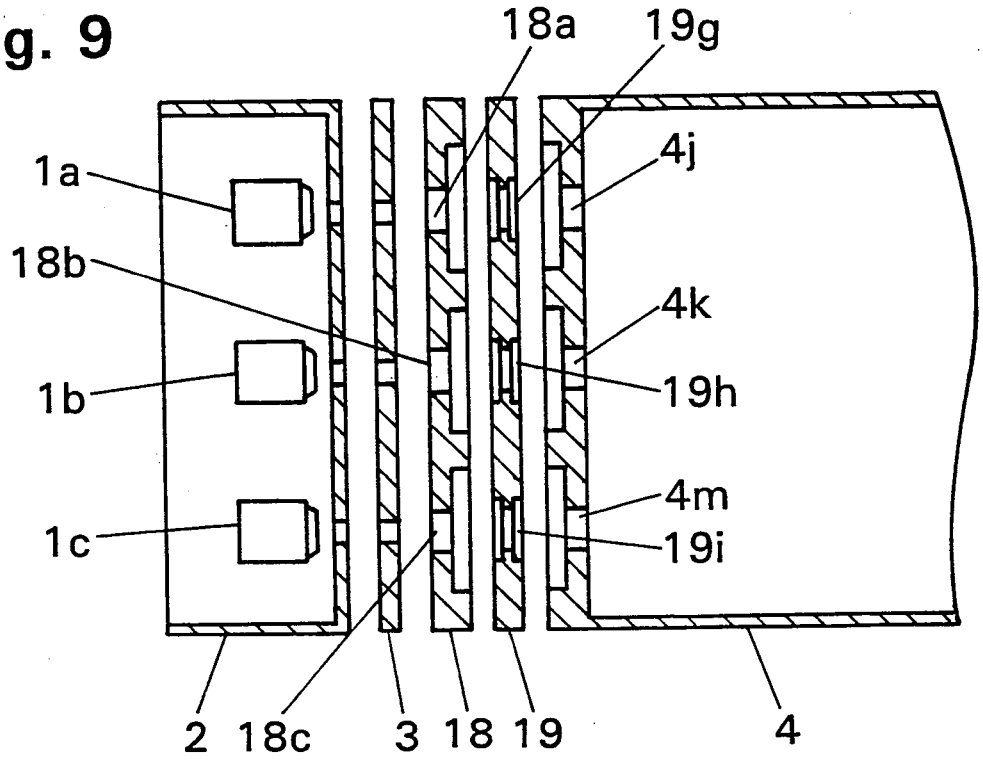
FIG. 9 is a cross-sectional view showing a main portion of still another electron gun of this invention.
Figure 10A:
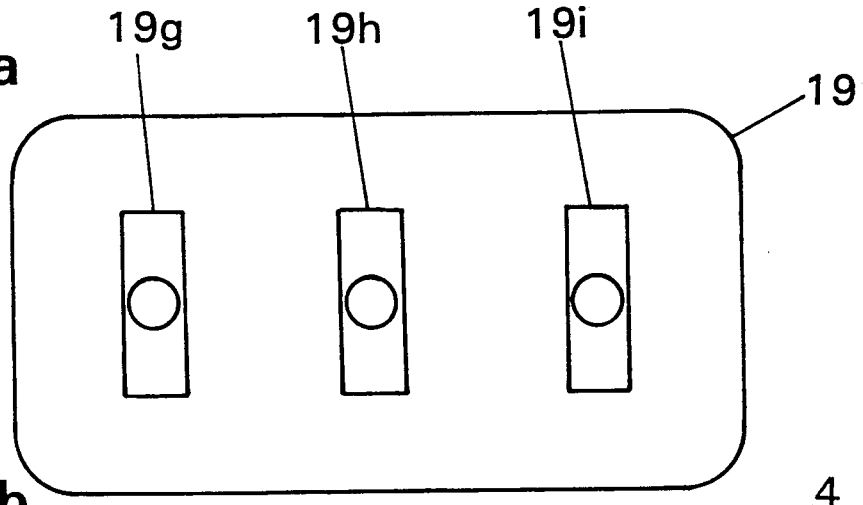
FIGS. 10*a* and 10*b* are side views of individual grids in the electron gun of FIG. 9.
Figure 10B:
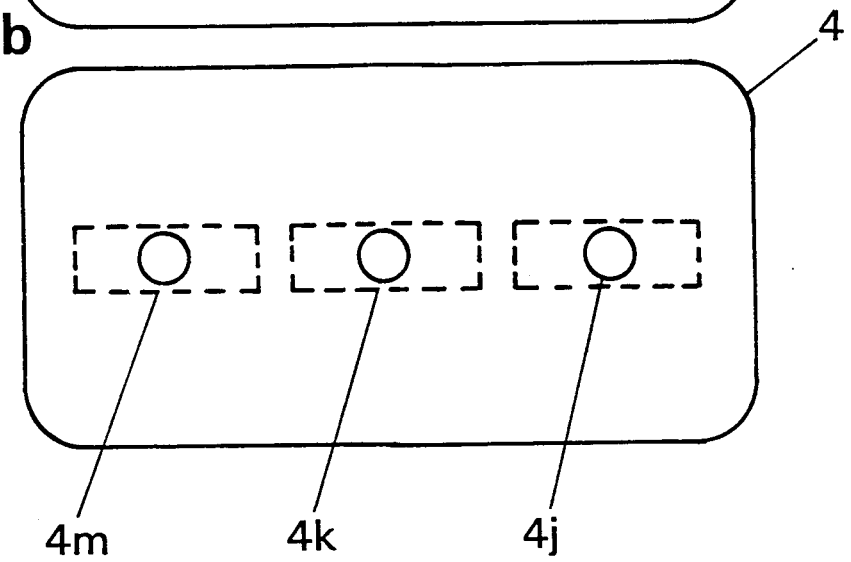

FIG. 9 shows still another embodiment of this invention, in which electron-beam through-holes 19*g* to 19*i* of the second auxiliary grid 19 have a round-configured aperture in their respective medial plate portion and a vertically elongated opening at both ends, as shown in FIG. 10*a*, and electron-beam through-holes 4*j*, 4*k*, 4*m* at one end adjacent to the second auxiliary grid 19 are open in round configuration, accompanied with a horizontally elongated aperture, as shown in FIG. 10*b*.

EXAMPLE 5

Figure 11:
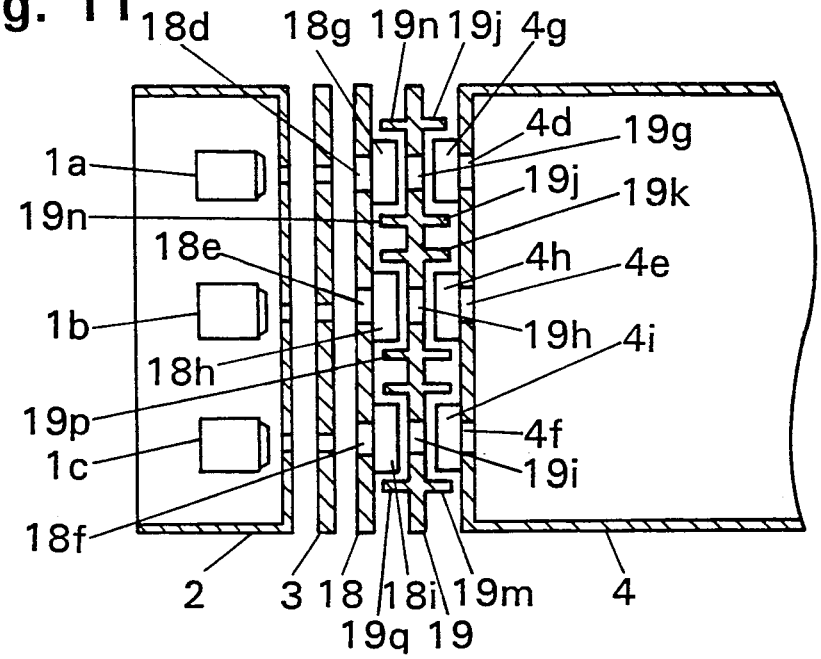
FIG. 11 is a cross-sectional view showing still another electron gun of this invention.
Figure 12A:
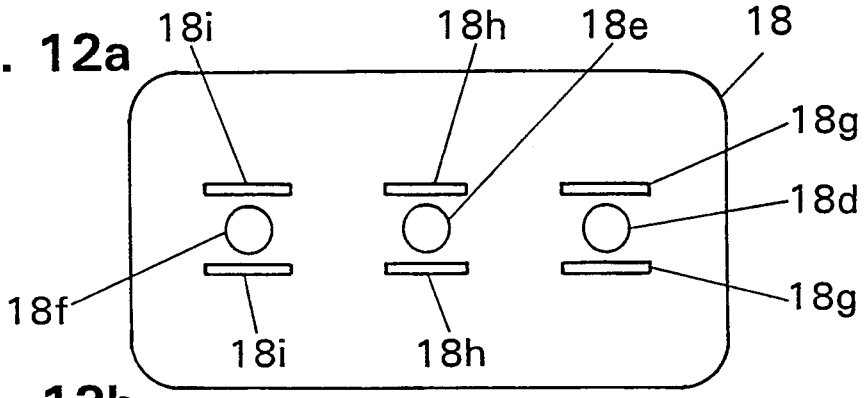
FIGS. 12*a* to 12*c* are side view of individual grids in the electron gun of FIG. 11.
Figure 12B:
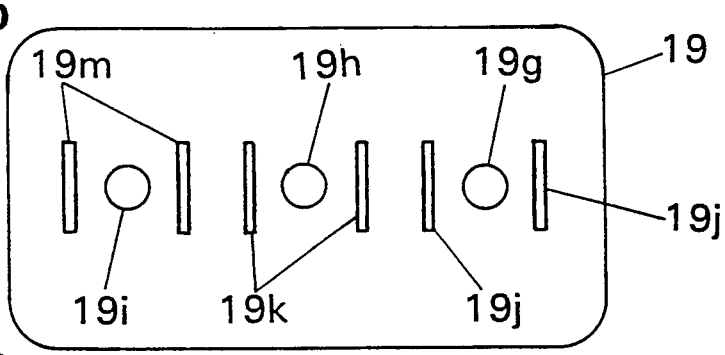
Figure 12C:
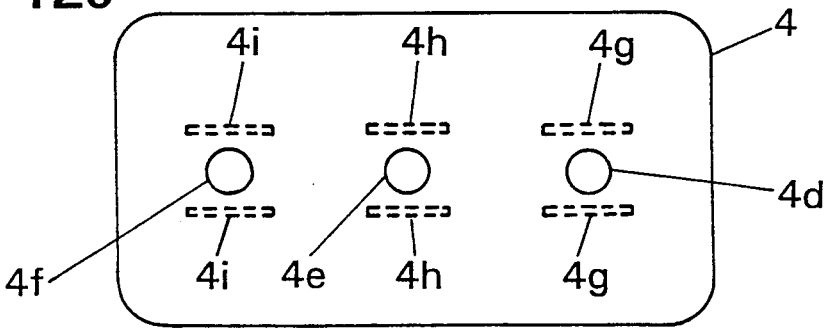
Figure 13:
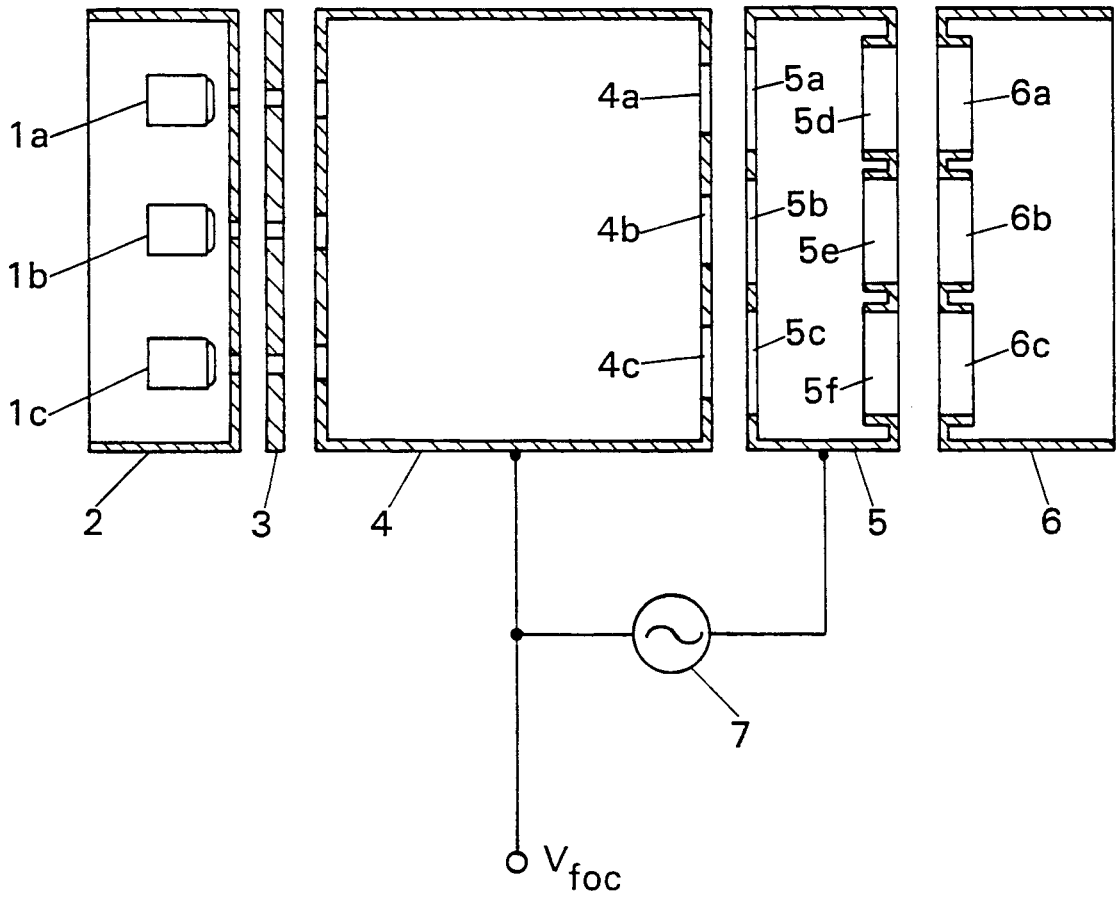
FIG. 13 is a cross-sectional view showing a conventional electron gun in a conventional color cathode ray tube apparatus.
Figure 14A:
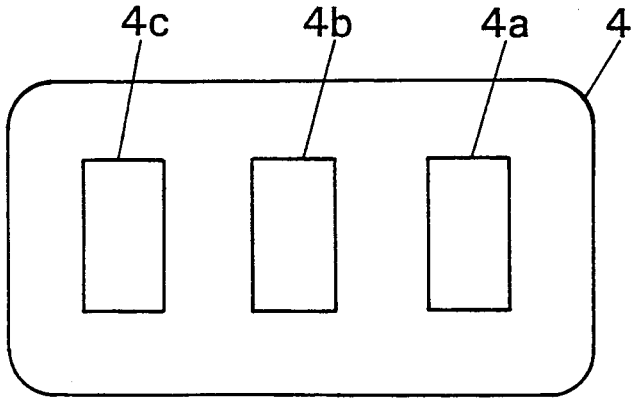
FIGS. 14*a* and 14*b* are side views of the electron gun of FIG. 13.
Figure 14B:
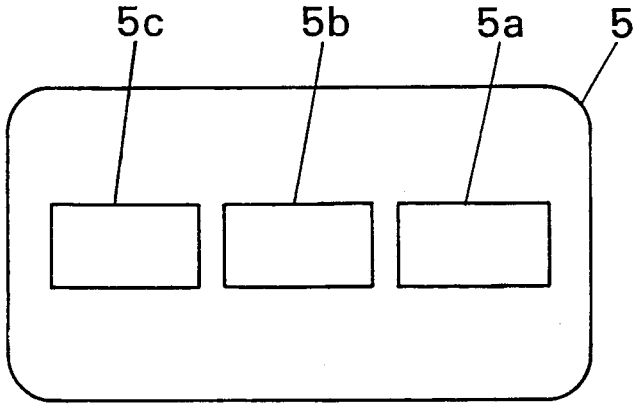
Figure 15:
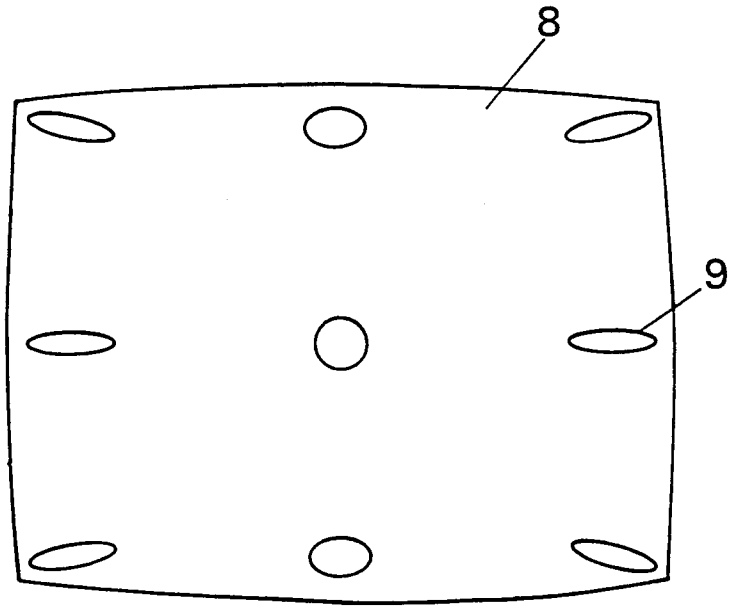
FIG. 15 is a plan view schematically showing the configuration of beam spots formed on the phosphor screen of the apparatus of FIG. 13.
Figure 16A:
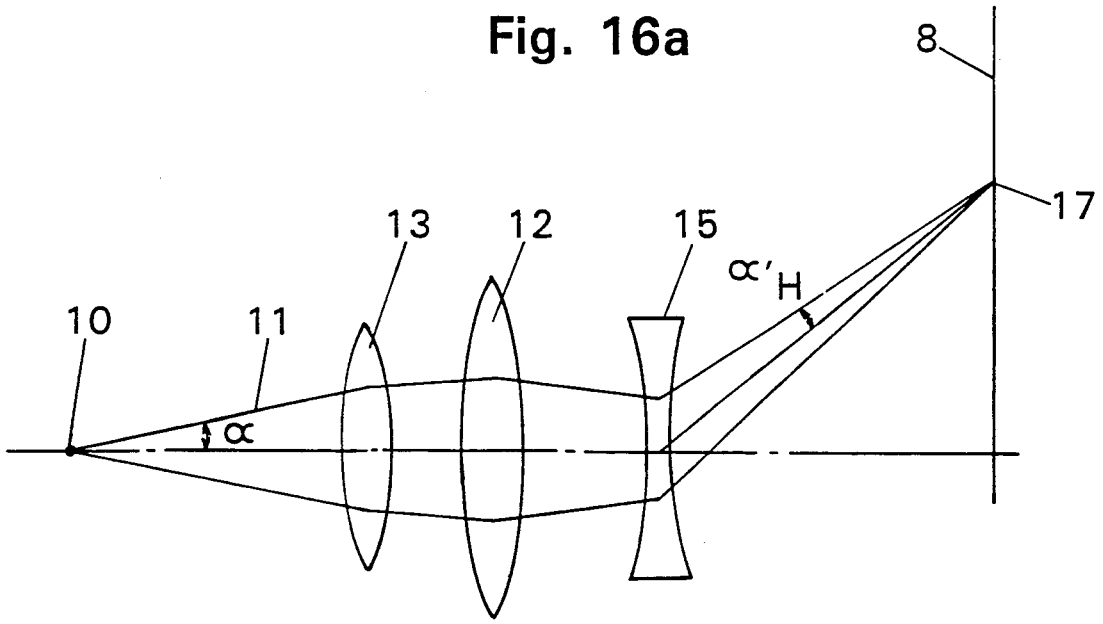
FIGS. 16*a* and 16*b*, respectively, are schematic diagrams showing an optical lens system in place of horizontal and vertical lens fields acting on electron beams in the gun of FIG. 11.
Figure 16B:
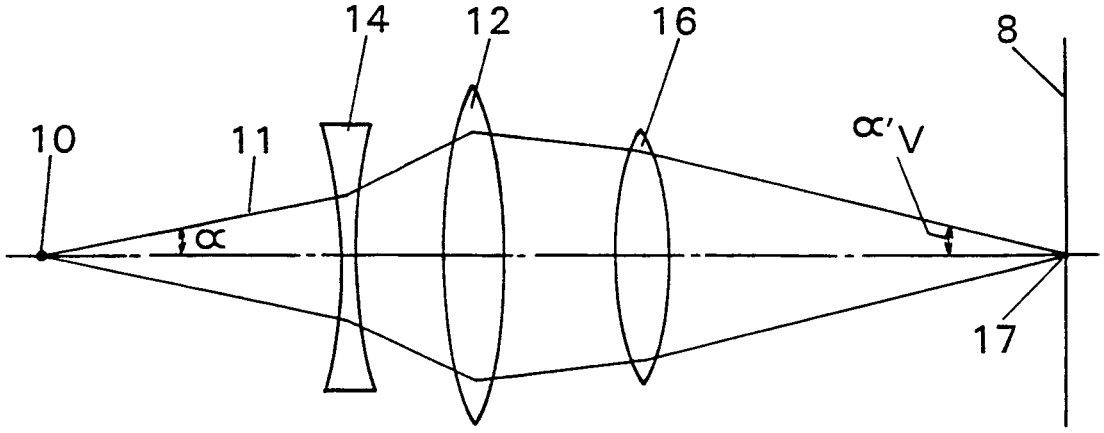

In still another embodiment shown in FIG. 11, electron-beam through-holes 18*d*,, 18*e*, 18*f*; 19*g*, 19*h*, 19*i*; and 4*d*, 4*e*, 4*f* of the first auxiliary grid 18, second auxiliary grid 19, and the first focusing grid 4 at one end adjacent to the second auxiliary grid 19 are all round-configured, and as shown in FIGS. 12*a* to 12*c*, the first auxiliary grid 18 has, at one end adjacent to the second auxiliary grid 19, a pair each of ledge portions 18*g*, 18*h*, 18*i*, and the first focusing grid 4 has, at one end adjacent to the second auxiliary grid 19, a pair of ledge portions 4*g*, 4*h*, 4*i*, each of the said ledge portions projecting horizontally from positions above and below the respective electron-beam through-holes of the grids 18, 4. Moreover, the second auxiliary grid 19 has at both ends thereof pairs of ledge portions 19*j*, 19*k*, 19*m*; 19*n*, 19*p*, 19*q* projecting vertically at both sides of the respective electron-beam through-holes 19*g*, 19*h*, 19*i* of the grid 19. All these through-holes are operative as astigmatic lens field forming means.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains

What is claimed is:

1. An in-line electron gun comprising a plate shaped accelerating grid to which a constant accelerating voltage is applied; a box-shaped first focusing grid to which a constant focus voltage is applied; a box-shaped second focusing grid to which a dynamic voltage is applied, said dynamic voltage gradually rising from the focus voltage with an increase in the deflection angle of electron beams, and said three grids being arranged in this order between a control grid and an anode; and astigmatic lens field forming means which are provided in at least one of the opposed ends of said first and second focusing grids so as to form first lens fields between said two focusing grids said first lens fields being convergent in a horizontal direction and divergent in a vertical direction, wherein said in-line electron gun comprises a flat plate-shaped first auxiliary grid connected to said first focusing grid; a flat plate-shaped second auxiliary grid connected to said second focusing grid, said auxiliary grids being arranged in this order between said accelerating grid and said first focusing grid; and astigmatic lens field forming means provided in at least one of the opposed ends of said first and second auxiliary grids so as to form second lens fields between said two auxiliary grids said second lens fields being divergent in a horizontal direction and convergent in a vertical direction.

2. An in-line electron gun according to claim 1, wherein astigmatic lens field forming means are provided in at least one of the opposed ends of said second auxiliary grid and first focusing grid.

3. An in-line electron gun according to claim 1, wherein each electron-beam through-hole of said first auxiliary grid has a non-circular aperture having a horizontally extending major axis, at its end adjacent to said second auxiliary grid; each electron-beam through-hole of said second auxiliary grid has a non-circular aperture having a vertically extending major axis, at its end adjacent to said first auxiliary grid and also has a circular aperture at its end adjacent to said first focusing grid; and said first focusing grid has circular electron-beam through-holes at its end adjacent to said second auxiliary grid.

4. An in-line electron gun according to claim 2, wherein each electron-beam through-hole of said first auxiliary grid has a non-circular aperture having a horizontally extending major axis, at its end adjacent to said second auxiliary grid; each electron-beam through-hole of said second auxiliary grid has a non-circular aperture having a vertically extending major axis, at its end adjacent to said first auxiliary grid and also has a circular aperture at its end adjacent to said first focusing grid; and said first focusing grid has circular electron-beam through-holes at its end adjacent to said second auxiliary grid.

* * * * *